US006422455B1

(12) United States Patent
Cahill et al.

(10) Patent No.: US 6,422,455 B1
(45) Date of Patent: Jul. 23, 2002

(54) COMPOSITE CONTAINER FOR VACUUM PACKAGING FOOD PRODUCTS SUCH AS DOUGH AND ASSOCIATED METHODS

(75) Inventors: Glenda J. Cahill; James W. Lowry, both of Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/543,779

(22) Filed: Apr. 5, 2000

(51) Int. Cl.[7] ..... B65D 3/10; B65B 31/00

(52) U.S. Cl. ..... 229/201; 53/79; 53/405; 206/524.8; 229/4.5; 229/164.2

(58) Field of Search ..... 229/4.5, 201, 164.2; 220/62.18, 62.21, 62.22, 592.27; 206/524.8, 830; 426/118, 128; 53/79, 405, 452

(56) References Cited

U.S. PATENT DOCUMENTS

| | | | | |
|---|---|---|---|---|
| 2,793,126 | A | | 5/1957 | Fienup et al. |
| 3,035,753 | A | | 5/1962 | Erekson |
| 3,113,714 | A | | 12/1963 | Stump |
| 3,144,193 | A | | 8/1964 | Geist et al. |
| 3,154,237 | A | | 10/1964 | Culley |
| 3,174,676 | A | | 3/1965 | Stump et al. |
| 3,182,891 | A | | 5/1965 | Ecklund et al. |
| 3,304,185 | A | | 2/1967 | Fortney |
| 3,366,493 | A | | 1/1968 | Stump |
| 3,397,834 | A | | 8/1968 | Hanlon et al. |
| 3,441,197 | A | | 4/1969 | White |
| 3,510,050 | A | | 5/1970 | Culley et al. |
| 3,712,534 | A | | 1/1973 | Fienup et al. |
| 3,981,443 | A | | 9/1976 | Thornhill et al. |
| 4,158,425 | A | | 6/1979 | Sansbury |
| 4,295,840 | A | | 10/1981 | Sansbury |
| 4,343,427 | A | | 8/1982 | Sansbury |
| 4,381,315 | A | | 4/1983 | Yong et al. |
| 4,459,793 | A | | 7/1984 | Zenger |
| 4,466,553 | A | | 8/1984 | Zenger |
| 4,919,949 | A | | 4/1990 | Miltz et al. |
| 5,076,440 | A | | 12/1991 | Drummond |
| 5,084,284 | A | | 1/1992 | McDilda et al. |
| 5,242,085 | A | | 9/1993 | Richter et al. |
| 5,251,809 | A | | 10/1993 | Drummond et al. |
| 5,344,045 | A | | 9/1994 | Richter et al. |
| 5,435,452 | A | | 7/1995 | Nishigami et al. |
| 5,547,451 | A | | 8/1996 | Drummond et al. |
| 5,556,365 | A | | 9/1996 | Drummond et al. |
| 5,829,669 | A | | 11/1998 | Drummond et al. |
| 5,846,619 | A | | 12/1998 | Cahill et al. |
| 5,971,259 | A | | 10/1999 | Bacon |
| 5,988,493 | A | * | 11/1999 | Clougherty ..... 229/4.5 |
| 6,053,400 | A | * | 4/2000 | Rea ..... 229/4.5 |
| 6,074,677 | A | * | 6/2000 | Croft ..... 206/524.8 |

* cited by examiner

*Primary Examiner*—Gary E. Elkins
(74) *Attorney, Agent, or Firm*—Alston & Bird LLP

(57) ABSTRACT

A tubular container for expansible food products is provided according to the present invention that includes a flexible liner having opposed end portions secured to respective ends of a tubular body wall. The tubular body wall has opposed ends and inner and outer surfaces and comprises a wound strip of material having opposed side edges. An end closure is secured to each end of the tubular body wall and can hermetically seal the container. A vent hole may be formed through the body wall and the label by way of a laser for allowing the passage of air therethrough. The flexible liner is secured to the respective ends of the tubular body wall by way of an adhesive band between the liner and the inner surface of the tubular body wall. The flexible liner thus has a free medial portion between the end portions which moves inwardly against the expansible food product when a vacuum is applied during packaging, and which also then moves outwardly against the inner surface of the tubular body wall as the product expands. The liner preferably comprises a flexible and stretchable liner formed of at least one polymeric layer without foil and paper layers.

23 Claims, 4 Drawing Sheets

COMPOSITE CONTAINER FOR VACUUM PACKAGING FOOD PRODUCTS SUCH AS DOUGH AND ASSOCIATED METHODS

FIELD OF THE INVENTION

The invention relates to composite containers, and in particular relates to composite containers for vacuum packaging expansible food products, such as dough products, and associated methods.

BACKGROUND OF THE INVENTION

Food and drink products and other perishable items are often packaged in tubular composite containers that are sealed at both ends. These composite containers typically include at least one structural body ply made of paperboard and are formed by wrapping a continuous strip of the body ply material around a mandrel of a desired shape to create a tubular structure. The body ply strip may be spirally wound around the mandrel or passed through a series of forming elements so as to be wrapped in a convolute shape around the mandrel. At the downstream end of the mandrel, the tube is cut into discrete lengths and fitted with end caps to form the container. Tubular containers of this type typically include a liner ply on the inner surface of the paperboard body ply. The liner ply prevents liquids from leaking out of the container and also prevents liquids from entering the container and possibly contaminating the food product contained therein. Preferably, the liner ply is also resistant to the passage of gasses so as to prevent odors of the food product in the container from escaping and to prevent atmospheric air from entering the container through the liner and spoiling the food product. The liner ply is often a laminate including kraft paper, aluminum foil and/or one or more polymer layers. Thus, the liner ply provides barrier properties and the body ply provides structural properties for the composite container.

"Easy-open" Containers for Expansible Food Products

Composite containers for packaging products under pressure, particularly refrigerated dough products, constitute a significant commercial consumer product. The pressure is caused by the dough expanding after it has been packaged. The leavening of the dough, also known as rising or "proofing," causes the generation of byproduct gasses, primarily carbon dioxide, which outgas from the dough into any surrounding air pockets or headspace. The byproduct gasses also build up within the dough itself which causes expansion of the dough. The proofing thus places outward pressure on the container and can create concerns of premature opening of the container.

To obtain easy consumer openability of these types of dough containers, the body wall is intentionally designed to provide little circumferential strength and thus the body ply strip is often joined at its edges by a butt joint that is lightly adhered or not even adhered at all. This facilitates opening of the container by first removing the label and then striking the tubular body wall against a hard and relatively sharp surface, such as the edge of a kitchen countertop, to separate the body ply edges and obtain access to the food product therein. The outer label surrounding the butt joint in containers of this type is thus an important structural component of the container because the outer label bridges the butt joint and maintains it in a closed position. Accordingly, the label must have sufficient circumferential strength to prevent premature opening of the container. On the other hand, once the label is removed, the seam of the body ply should be fairly easily separated to allow the consumer to gain access to the product.

Commercially significant containers of this type are disclosed in U.S. Pat. No. 3,981,433 to Thornhill, et al. which is directed to an "easy-open" container including an inner liner having a helical fold positioned opposite the helical butt joint. When the outer label is removed, the dough and the liner expand outwardly together as the liner fold or pleat begins to unfold. Resultant pressure on the body ply material causes the butt joint to open. This in turn allows the inner liner to expand further such that the liner is automatically opened by the rapidly expanding dough to allow access to the dough in the interior of the container by the consumer.

A complaint of some consumers of expansible dough products is that conventional easy-open dough containers create a loud report or "pop" when the container is first opened. The loud report can startle some consumers and is caused by the rapid decompression of the container upon opening. Accordingly, one goal of easy-open container manufacturers is to provide a container having a much quieter report upon opening.

Containers for Vacuum Packaging

Certain food products benefit from being packaged while under a vacuum. Vacuum packaging removes oxygen from the space surrounding the product, which can improve the shelf life of the product within the package. However, it is generally recognized that vacuum packaging with the easy-open containers of the butt joint type can only be accomplished with difficulty, if at all. Because of the structural design of the composite container, the application of vacuum to the interior of the container often results in partial or complete inward collapsing of the container walls along the butt joint seam. This can result in an unacceptable appearance for the composite container or an unacceptable sealing of the product within the container.

This problem is further discussed in U.S. Pat. No. 5,251,809 to Drummond, et al. The dough container according to one embodiment of the '809 patent has an overlapping joint or seam between the opposing edges of the body wall material formed by compressing marginal areas of the body ply material to a thickness which is less than the original thickness of the paperboard. A frangible adhesive is applied between the compressed overlapping edges such that the joint can be easily opened with an appropriate amount of pressure. Because of the strength imparted by the overlapping edges and frangible adhesive, the structural strength requirements for the outer label can be decreased without compromising the ability of the container to withstand the vacuum packaging operation.

Another approach to solving the problem of being able to vacuum package expansible food products such as dough is disclosed in U.S. Pat. No. 5,084,284 to McDilda, et al. The McDilda patent discloses a spiral wound composite container in which refrigerated dough can be packaged under a vacuum. As noted in the McDilda patent, the container is adapted to be opened by the application of an external force to the outer surface of the container yet is strong enough to withstand a vacuum environment during packaging of the dough. This is accomplished in the '284 patent by way of an angled skive joint between the opposed edges of the body ply. The skive joint has an included angle of about 3.5° and is held together with an adhesive, such as a dextrose and water combination. This joint is much stronger than conventional dough containers, so much so that the '284 patent explains that the body ply is sufficiently strong to prevent premature opening of the container and that, therefore, the label layer does not function to add circumferential strength. Unfortunately, the stronger body ply joint also makes it more difficult for the consumer to open the container and gain access to the product after the label ply has been removed.

Accordingly, there is a great need in the industry for a container that is easy to open for consumers, but that is also capable of allowing vacuum packaging of expansible food products. Such a container would advantageously not generate a loud report or pop upon opening and would not involve great difficulty in opening so as to be more friendly to consumers. At the same time, however, such a container would also be capable of withstanding the rigors of vacuum packaging so as to increase the shelf life of the product and provide other benefits attendant to vacuum packaging. Conventional containers, as shown above, have been unable to provide easy openability with vacuum packaging capability and the industry is in need of such a container.

SUMMARY OF THE INVENTION

These and other advantages are fulfilled by a tubular container for expansible food products according to the present invention which includes a flexible liner having opposed end portions secured to respective ends of a tubular body wall. Advantageously, the flexible liner has a free medial portion between the end portions that moves inwardly against the expansible food product when a vacuum is applied during packaging and that also then moves outwardly against the inner surface of the tubular body wall as the product expands. In this manner, the vacuum created during packaging does not act directly on the body wall thus allowing conventional easy opening body wall constructions for expansible food products to be used. A further advantage is that the report upon opening is much less relative to conventional containers because, as explained in more detail below, part of the expansion of the packaged food product is taken up by the outward expansion of the liner. As a result, the final pressure within the container, and thus the loudness of the report upon opening, are greatly reduced.

In particular, the tubular body wall has opposed ends and inner and outer surfaces and comprises a wound strip of material having opposed side edges. The strip is wound such that the opposed side edges are butted adjacent to each other. The butted edges of the strip of body wall material are not necessarily secured to each other.

An end closure is secured to each end of the tubular body wall and can hermetically seal the container. The end closures are, according to one embodiment, formed of a paperboard material. A label surrounds the outer surface of the tubular body wall. The label has a predetermined circumferential strength to at least partially resist expansion of the food product together with the circumferential strength of the body wall.

A vent hole can be formed through the body wall and the label, such as with a laser, for allowing the passage of air therethrough. The vent allows air to enter the cavity between the flexible liner and the inner surface of the tubular body wall and allows the medial portion of the liner to move inwardly against the food product as the volume of the food product is decreased.

The flexible liner is secured to the respective ends of the tubular body wall by way of an adhesive band between the liner and the inner surface of the tubular body wall adjacent each end of the tubular body wall. The free medial portion is between the opposed end portions of the liner. Thus, the medial portion is free to move inwardly against the expansible food product when vacuum is applied and then to move outwardly toward the inner surface of the tubular body wall as the expansible food product begins to expand. The liner preferably comprises a flexible and stretchable liner formed of at least one polymeric layer without foil and paper layers.

Associated methods also form a part of the invention and, according to one embodiment, include the steps of forming a tubular body wall with opposed ends and a flexible liner adjacent an inner surface of the body wall, closing one end of the tubular body wall and then depositing the expansible product within the liner and tubular body wall. The vacuum packaging operation can then be performed by applying a negative pressure to the open end of the tubular body wall such that the flexible liner is moved inwardly from the inner surface of the body wall against the product. The open end of the tubular body wall is then closed. The product then expands such that the flexible liner is moved outwardly towards the inner surface of the body wall and a positive pressure is created within the tubular body wall.

Accordingly, and as is explained in more detail below, the Applicants have provided a new container for expansible food products such as dough which overcomes the disadvantages of conventional containers. The new container is easy to open for consumers, but is also capable of allowing vacuum packaging of dough. The present container does not generate a loud report or pop upon opening because part of the expansion of the dough is taken up by the expansion of the medial portion of the flexible liner. The container can use conventional body wall and label construction techniques, such as a body ply butt joint, and thus involves no greater difficulty in opening for consumers than conventional dough containers. At the same time, however, the present container is capable of withstanding the rigors of vacuum packaging so as to increase the shelf life of the dough and provide other benefits attendant to vacuum packaging.

BRIEF DESCRIPTION OF THE DRAWINGS

Some of the objects and advantages of the present invention having been stated, others will appear as the description proceeds when taken in conjunction with the accompanying drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
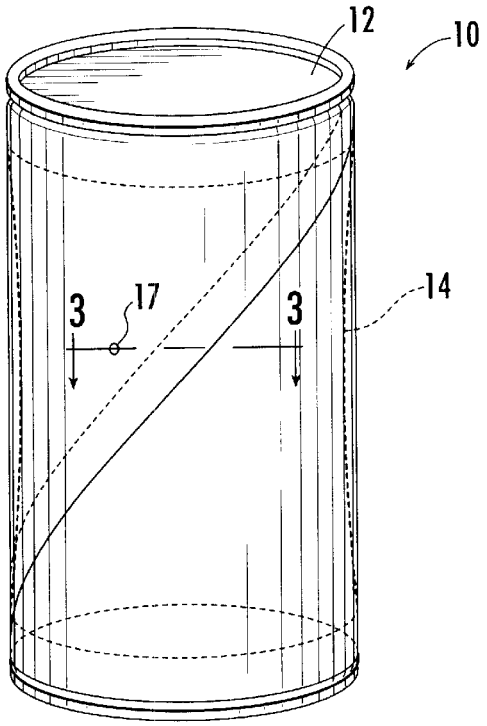
FIG. 1 is a perspective view of a container of the present invention.
Figure 2:
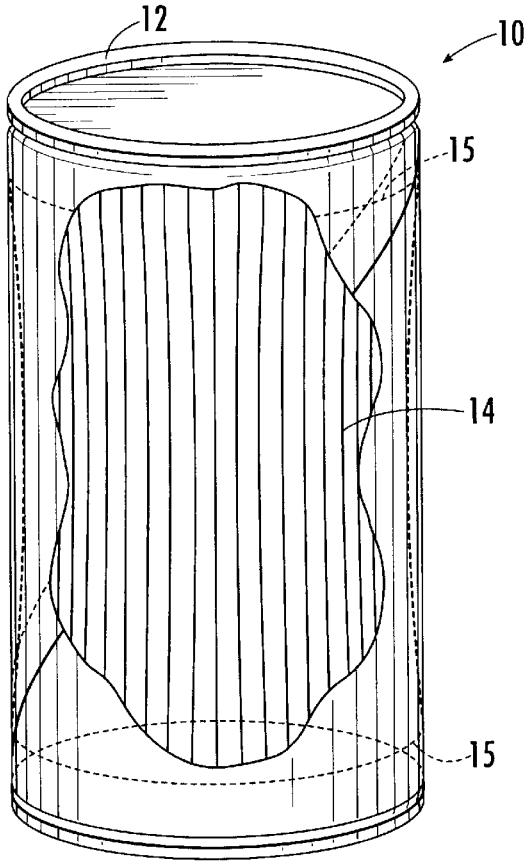
FIG. 2 is a fragmentary perspective view of a container of the present invention illustrating a liner therein after a product has been packaged in the container under a vacuum.

A tubular container 10 according to the present invention is illustrated in FIG. 1 and is particularly advantageous for packaging expansible food products 11, such as dough. As noted above, a mass of dough becomes physically larger because of the creation of byproduct gasses within the dough. Also, however, dough creates gasses that are outgassed from the dough and thus the term "expansible food products" as used herein is intended to include those products that become physically larger and/or those that create outgasses. Other food products that may expand or at least create gaseous byproducts after packaging include coffee and those having other chemical constituents.

Although illustrated as having a circular cross section, the tube of the container may have any cross sectional shape that can be formed by wrapping the tube around an appropriately shaped mandrel. One example is a generally rectangular shaped tube having rounded corners. As illustrated in more detail in FIGS. 3–6, the tubular container 10 includes a body wall comprising at least one body ply 13 that is preferably formed of a strip of paperboard. The tubular container 10 also includes a liner ply 14 that is preferably formed of a polymeric material adhered to the inner surface of the body ply 13. A label ply 16 is adhered to the outer surface of the body ply 13.

As with many easy-open dough containers, the edges of the strip of the body ply 13 are square and butted together and are not necessarily adhered together so as to facilitate easy opening. The label ply 16 is thus designed to provide a major portion of the resistance to the expansion of the pressurized dough to prevent premature opening. In other words, the circumferential strength of the label ply 16 is combined with the circumferential strength of the body ply 13, and both resist the expansion of the food product. In some instances, the liner ply 14 can also contribute to the total resistance of the container to the expansion of the dough.

The ends of the tubular container 10 are closed with end closures 12 that may be, for example, formed of metal caps. Other types of end closures that can be used include paperboard ends (which are in the form of a plug inside the tubular body wall); ends having a metal flange and a membrane-type lid adhered thereto; and membrane-type lids adhered directly to the ends of the liner ply 14 and body ply 13, depending on the application.

The liner ply 14 is typically constructed of multiple layers. Preferably, one of the layers forms a barrier to moisture and/or gasses. It will be understood that various barrier materials and liner plies could be employed depending upon the item being packaged. However, in a preferred embodiment, the liner ply 14 is substantially entirely formed of polymeric material. In particular, liner plies such as described in U.S. Pat. No. 5,829,669 to Drummond et al. or U.S. Pat. No. 5,846,619 to Cahill et al., both of which are assigned to the assignee of the present invention and are hereby incorporated by reference, may be used.

The barrier layer of the liner ply 14 is resistant to the passage of liquids and gasses such as oxygen. If a high barrier is required for both liquids and gasses, preferred barrier materials are metallized polyester or metallized polypropylene. Some food products 11 do not require a gas barrier and other barrier materials may be used (although the barrier may also be generally resistant to the passage of gasses). It will be understood that various barrier materials could be employed depending upon the product 11 being packaged. One surface of the barrier layer may include a thin metallized coating to provide a metallic appearance and also to enhance the barrier properties. The metallized coating, which may be formed of aluminum, is significantly thinner than a foil layer, however, and is not necessary for strength or barrier properties in certain applications.

Figure 3:
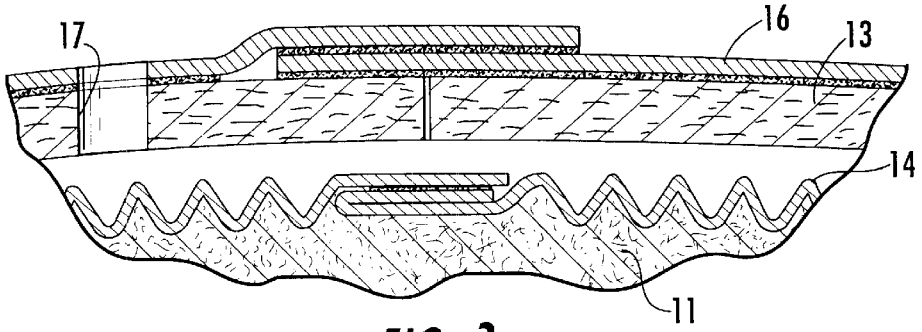
FIG. 3 is a greatly enlarged sectional view of the container of the present invention as seen along lines 3—3 of FIG. 1 shortly after the vacuum packaging operation.
Figure 4:
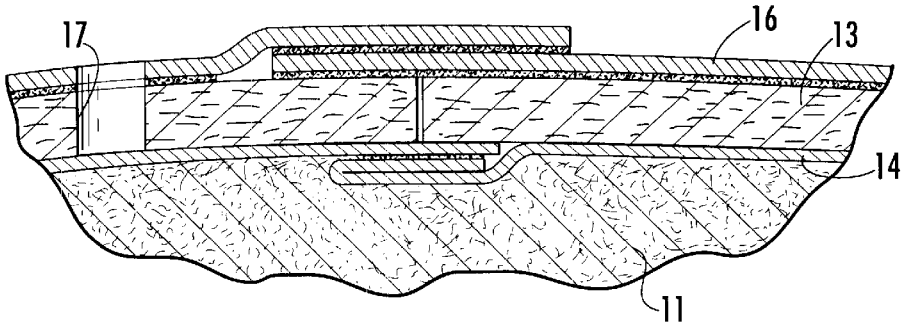
FIG. 4 is a greatly enlarged sectional view of the container of the present invention as seen along lines 3—3 of FIG. 1 after the food product therein has expanded.
Figure 5:
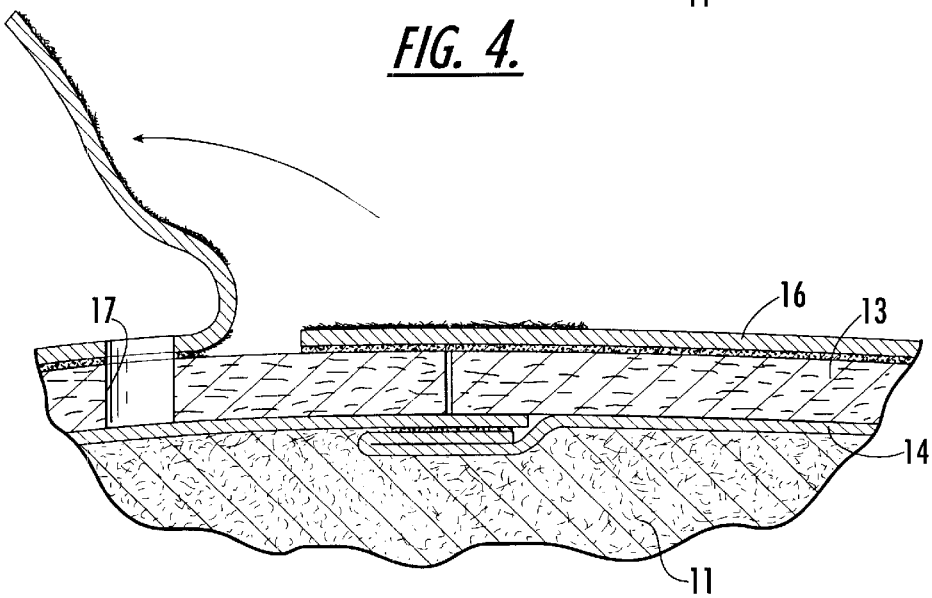
FIG. 5 is a greatly enlarged sectional view of the container of the present invention as seen along lines 3—3 of FIG. 1 illustrating the removal of the label ply.
Figure 6:
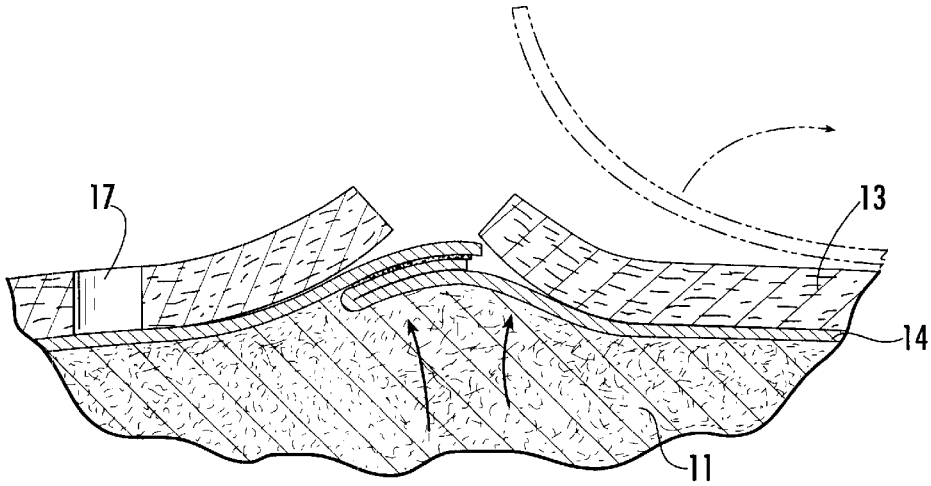
FIG. 6 is a greatly enlarged sectional view of the container of the present invention as seen along lines 3—3 of FIG. 1 illustrating the separation of the body ply seam and further expansion of the food product.

The manufacturing process discussed below creates a tubular container 10 wherein the axially opposed end portions of the liner ply 14 are adhered to the inner surface of the body ply 13 by a pair of adhesive bands 15. The adhesive bands 15 are separated such that a medial portion of the liner ply 14 between the axially opposed end portions remains free and unattached to the body ply 13. Accordingly, after the product 11 has been placed inside the cavity defined by the tubular liner 14, the cavity is subjected to a vacuum and the unattached medial portion of the liner ply will be withdrawn against the product as can be seen in FIG. 3.

U.S. Pat. No. 4,158,425 to Sansbury discloses a composite container comprising a tubular body and an inner liner coextensive with the length of the tubular body and affixed by adhesive to the opposed ends thereof. Opposed end caps are hermetically sealed on the ends of the container such that a vacuum can be drawn internal to the inner liner. The liner is thus withdrawn against the product packaged therein. However, this patent does not relate to the packaging of expansible dough products, and the liner remains in a withdrawn position after the product has been packaged and sent to the consumer. Thus, the Sansbury container is designed so that the food product is removed from the end of the container after the consumer removes one of the end caps. This arrangement is not suitable for packaging dough because dough is difficult to remove through the ends of tubular containers. No provision is made in the Sansbury container for removal of the product through the body wall of the can and the withdrawn liner therein.

Advantageously, unlike the Sansbury '425 patent, the present invention allows for the packaging of expansible food products 11, and, in particular, the packaging of expansible food products under a vacuum. As discussed above, expansible food products such as dough are conventionally allowed to "proof" or expand after the packaging operation. With the present invention, the expansion of the product 11 is readily accommodated by the return of the liner ply 14 from the withdrawn position to a position adjacent the body ply 13. As the product 11 expands, the liner ply 14 is gradually straightened out and moved towards the position that the liner ply occupied when the container was manufactured. The final position of the liner ply 14 after a least part of the expansion of the product 11 can be seen in FIG. 4.

Figure 8:
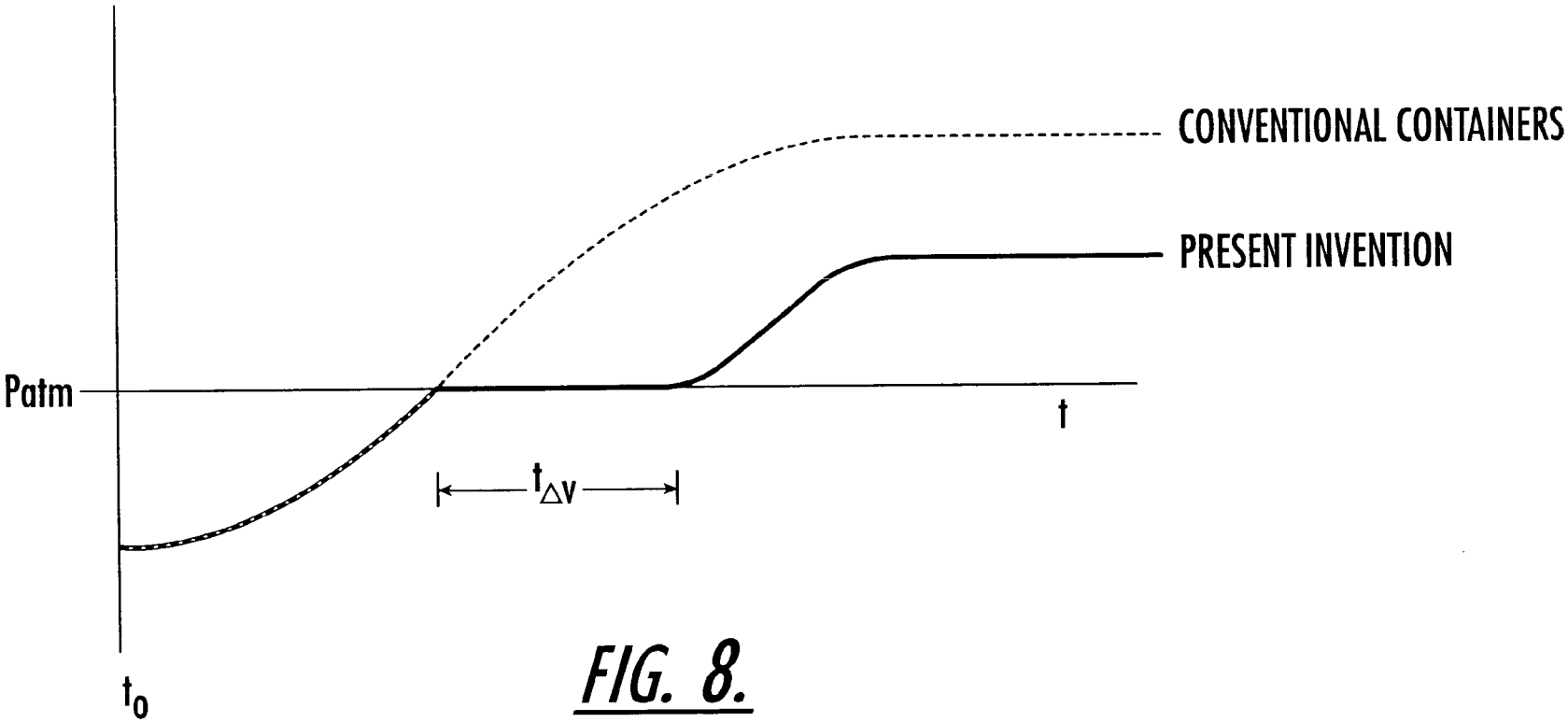

One significant advantage of the present invention is that the final pressure within the container 10 is greatly reduced in comparison to conventional dough containers. A complaint of some consumers of expansible dough products is that conventional easy-open dough containers create a loud report or "pop" when the container is first opened. This is caused by the rapid decompression of the container upon opening of the container. With the present invention, however, the final packaged pressure within the container 10 is greatly reduced because part of the expansion of the product 11 is accommodated by the increase in volume of the liner ply 14. This phenomenon is illustrated in FIG. 8.

The pressure curves for conventional containers and containers 10 according to the present invention are plotted (as a dashed line) over time relative to atmospheric pressure, denoted by $P_{atm}$. The instant in time immediately after the completion of the vacuum packaging process is denoted by $t_0$. It is assumed that conventional containers and containers according to the present invention are subjected to the same degree of vacuum, which for dough is often about 450 mm of mercury (absolute).

With conventional containers, the volume of the cavity in which the dough is packaged remains fixed. Thus the internal pressure gradually increases from the negative pressure immediately after packaging to a positive pressure at which the proofing of the dough is completed. At some point during the proofing process, the pressure within the container instantaneously crosses atmospheric pressure $P_{atm}$.

With a container according the present invention, however, the pressure inside the liner ply 14 of the container remains at atmospheric pressure during part of the proofing process as denoted by the interval $t_{\Delta v}$. During this time, the expansion of the dough is accommodated by an increase in volume of the liner ply 14, and not by an increase in the internal pressure. At some point, the volumetric expansion of the liner ply 14 is completed (when it is positioned fully against the inside of the body ply 13) and the pressure inside the liner ply begins to climb above atmospheric pressure $P_{atm}$. The total proofing process takes about four hours to complete. As a result of the interval $t_{\Delta}$, however, the final pressure of the dough within containers according to the present invention is less than the final pressure within conventional containers. For example, conventional containers can have a final internal pressure in the range of 15–30 psig (pounds per square inch above atmospheric or "gauge" pressure) whereas containers according the present invention can have an internal pressure of between about 8 to about 10 psig. Thus the decompression of the container upon opening is much less and the attendant report is advantageously reduced to a more acceptable level.

An additional advantage of the container according to the present invention is that the container can be hermetically sealed. It is common in dough containers to intentionally create a nonhermetically sealed container. For example, metal end closures of conventional containers may be provided with a "false seam" which creates tiny passages for gasses to pass therethrough. The reason for this is to allow byproducts outgassed during the proofing process to be vented to the atmosphere. If these gasses were allowed to build up in the container without being vented, the gas could cause the container to rupture outwardly. With the present invention, however, the final pressure within the container is much less than conventional containers and thus does not require venting of the generated gasses. Accordingly, the container of the present invention can be hermetically sealed which is generally more appealing to consumers.

Further, the vacuum packaging of the dough provides greater volume of the dough products after they have been baked. This beneficial effect is the result of a smaller percentage of carbon dioxide in the dough product being lost during the packaging operation.

The lower final pressure inside the container 10 thus improves the strength and integrity of the container upon shipping. If desired, the resistance of the tubular portion of the container 10 to outward rupturing can be decreased. The circumferential strength of the materials used to resist expansion can be lessened relative to conventional containers by, for example, reducing the thickness of the paperboard body ply 13 and/or the label ply 16, changing the type of materials used for the body ply 13 and/or the label ply 16, and reducing the thickness or adherability of the adhesive holding the label ply 16 to the body ply 13. All of these modifications can result in reduced cost for the container manufacturer, the product packager and ultimately the consumer.

Liner plies 14 of conventional composite containers are often formed of a layer of aluminum foil backed with a layer of kraft paper. The foil layer provides the barrier properties and the kraft paper is provided to allow adherence of the foil layer to the paperboard body ply. However, the liner plies of conventional composite containers, such as the '425 patent to Sansbury, can be problematic where the liner ply is flexed inwardly by a substantial amount or in both directions, such as with the present invention. Aluminum foil is not very elastic and, if subjected to excessive or repetitive stretching, can become damaged with cracks, tears or pinholes. If the foil is so damaged, the barrier properties will be sacrificed and the shelf life of the product 11 within the container will be limited.

The polymeric liner ply 14 according the present invention, however, is not limited in this regard because the liner ply has greater flexibility and stretchability and readily conforms to the product 11 being packaged. As can be seen in FIGS. 2–6, the liner ply 14 is subjected to significant deformation and, when the product 11 being packaged is dough, the liner ply can take an axially fluted shape immediately after the vacuum packaging operation. Multiple corrugations of the liner ply 14 are spaced around the circumference of the vacuum packaged product 11 and account for the full circumference of the liner ply before the vacuum is applied (and after the product has subsequently expanded against the body ply 13). In addition, unlike the Sansbury '425 container, the liner ply 14 of the present invention is both withdrawn inwardly and subsequently expanded outwardly creating a repetitive-type stress on the liner.

Figure 7:
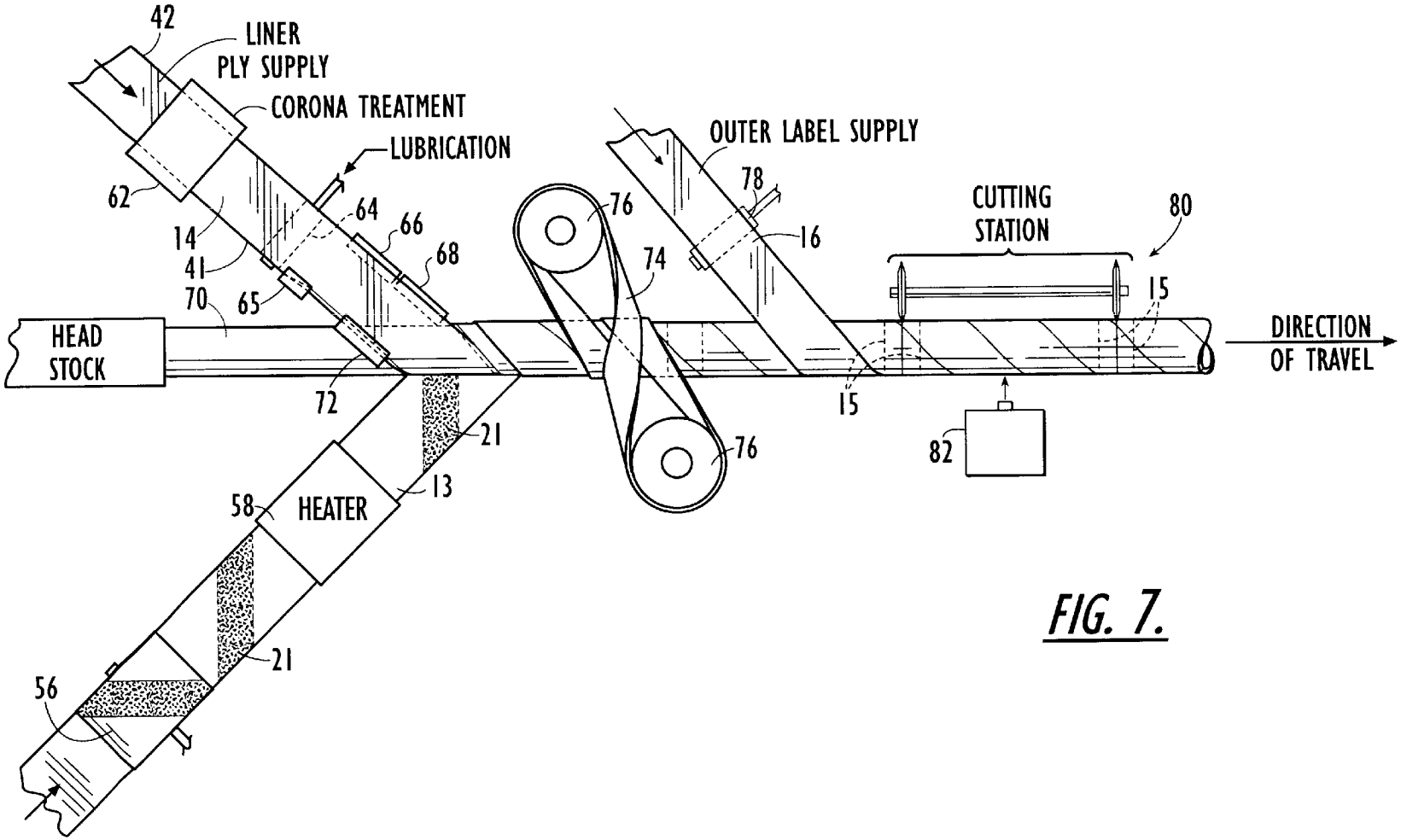
FIG. 7 is a plan view of an embodiment of an apparatus for making a tubular container according to the present invention; and, FIG. 8 is a graph illustrating the pressure of the food product over time both as packaged with the present invention and packaged in conventional containers according to the prior art.

The containers 10 of the present invention may be manufactured by the process illustrated in FIG. 7. As shown, a continuous strip of paperboard body ply material 13 is supplied to a shaping mandrel 70. The edges of the body ply material 13 are preferably not skived or compressed or otherwise shaped to facilitate bonding to each other when wrapped around the mandrel 70. As such, the edges of the body ply retain a substantially square shape as shown in FIGS. 3–6.

The strip of body ply material 13 is advanced through an adhesive applicator 56 which applies an adhesive 21 to the upper surface of the body ply 13. The applicator 56 is, according to one embodiment, a roller to which the adhesive 21 is applied in a predetermined pattern corresponding to the desired ultimate adhesive pattern that adheres the liner ply 14 to the body ply 13. For example, the adhesive 21 can be applied to the roller in a plurality of spaced apart strips which correspond to the adhesive bands 15 that adhere the end portions of the liner ply 14 to the body ply 13 in a finished container.

The adhesive 21 is advantageously an aqueous adhesive, which overcomes the many problems associated with solvent-based adhesives. No special equipment is needed to capture solvents that evaporate from the adhesive in order to comply with environmental regulations. Preferred adhesives are aqueous low glass transition temperature ethylene vinyl acetate (>18%) materials. One preferred adhesive is No. 72-4172, which is available from the National Starch and Chemical Company. Another adhesive that may be used is No. 33-4060, which is also available from the National Starch and Chemical Company. The adhesive 21, as well as other adhesive layers used to construct the container 10, may be applied in the form of a foam as described in copending U.S. patent application Ser. No. 09/197,275 entitled, "Composite Container Having Foamed Adhesive," which is assigned to the assignee of the present invention and hereby incorporated by reference. The body ply 13 and wet adhesive 21 applied thereto are then passed underneath a heater 58 which evaporates at least part of the water content of the aqueous adhesive 21 to render the adhesive substantially tacky. A preferred type of heat source is an infrared heater although various other heat sources, e.g., forced air heating or the like can be used.

A continuous strip of liner ply 14 material is advanced from an opposite side of the shaping mandrel 70 and defines a first marginal edge portion 41 and a second marginal edge portion 42. The surface of the liner ply 14 that contacts the body ply 13 is subjected to a corona treatment station 62. The opposite surface of liner ply 14 is coated with lubricant from a roller 64, which allows the liner ply to slide smoothly during the winding operation. The liner ply 14 is then passed through an edge folder 65, which folds over the first marginal edge portion 41 to create an anaconda fold in the liner, and adjacent to an infrared heater 66, which heats the second marginal edge portion 42 of the liner ply. After the infrared heater 66, the second marginal edge portion 42 of the liner ply 14 is then passed adjacent to at least one forced air heater 68.

The body ply 13 and the liner ply 14 are then wrapped around a shaping mandrel 70 from opposite sides of the mandrel. Each ply is first wrapped around the mandrel 70 in a helical fashion with the liner ply 14 wound against the surface of the mandrel. The first marginal edge portion 41 of the liner ply 14 is exposed on the mandrel 70 and is subjected to heat from a second forced air heater 72.

With regard to the liner ply 14, the second marginal edge portion 42 is brought into an overlapping relationship with the first marginal edge portion 41 to create a sealed anaconda seam. The seal is formed by polymeric seal layers of the first and second marginal edges 41, 42 becoming bonded to each other. However, a strip of hot melt adhesive or other adhesives and methods could alternatively be used for securing and sealing the liner overlap.

The substantially square edges of the body ply 13 are abutted together over the liner ply to create the arrangement illustrated in FIGS. 3–6. In one advantageous embodiment, the edges of the body ply 13 are not adhered to each other. In another embodiment, an adhesive is applied between the edges to provide additional strength if necessary.

The tube is then advanced down the mandrel 70 by a conventional winding belt 74, which extends around a pair of opposed pulleys 76. The winding belt 74 not only rotates and advances the tube, but also applies pressure to the overlapping edges of liner ply 14 to ensure a secure bond between the ply edges.

The outer label ply 16 is then preferably passed over an adhesive applicator 78 and wrapped around the body ply 13. The label ply 16 could be applied before the winding belt 74. At a cutting station 80, the continuous tube is cut into discrete lengths and removed from the mandrel 70. The cut is positioned to divide the adhesive strips created by the applicator 56 so as to create adhesive bands 15 for the opposite ends of successive containers.

In containers such as the container described in the Sansbury '425 patent, a vacuum can be rapidly applied during the packaging operation. Such a rapid application of vacuum could cause problems with an easy-open container for expansible food products, however, because of the intentionally weak body ply seam. The volumetric decrease of the liner ply 14 creates a negative pressure in the cavity between the exterior surface of the liner ply 14 and the inner surface of the body ply 13. This creates a pressure differential across the body ply 13 that could cause a collapse of the body ply 13. Advantageously, a vent hole 17 is provided through the body ply 13 and the label ply 16 of the present invention to allow air to fill the cavity between the exterior surface of the liner ply 14 and the inner surface of the body ply 13. The vent hole 17 thus alleviates the pressure differential on the body ply 13 and prevents collapse of the body ply. The vent hole 17 can be formed at the cutting station with a laser device 82 which is intermittently pulsed to bum a hole through the label ply 16 and body ply 13 for each container length.

The end closures 12 are then attached to the ends of the tubular body ply 13. A preferred metal end closure is disclosed in U.S. Pat. No. 5,971,259, which is assigned to the assignee of the present invention and incorporated herein by reference. The end closure 12 can be provided with a sealing compound to effect a hermetic seal if desired. Typically, an end closure 12 is applied to one end of the tubular body ply 13 prior to filling of the container. After filling with the product 11, a vacuum is applied to the open end of the tubular body that removes at least part of the air remaining within the cavity defined by the liner ply 14 and the attached end closure. Before the vacuum is released, another end closure is applied to the opposing end of the tubular body. The vacuum is then released and, in the case of dough, the proofing process begins immediately. The product expands so that the liner ply 14 moves from the withdrawn position to a fully expanded position as discussed above. The proofing process will typically be completed before the container reaches the consumer.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, although much of the discussion herein is specifically directed to containers for dough which expands because of its chemical properties, it is to be understood that other products can be packaged in containers according to the invention and can undergo volumetric contraction and expansion such as certain "hot-filled" products (juice is an example) which contract upon cooling. In addition, ambient conditions can affect the relative volume of the food product such as altitude or temperature extremes experienced during shipping or at delivery of the containers. Although specific terms are employed herein, they are used in a generic and descriptive sense only and not for purposes of limitation.

That which is claimed:

1. A container for vacuum packaging food products of a type which expand prior to the container being opened and create a positive internal pressure within the container, said container comprising:

a tubular body wall having opposed ends and inner and outer surfaces and comprising a wound strip of material having opposed side edges, said strip being wound such that the opposed side edges are butted adjacent to each other;

an end closure secured to one end of the tubular body wall;

a label surrounding the outer surface of the tubular body wall; and a flexible liner having opposed end portions secured to respective ends of the tubular body wall and a free medial portion between the opposed end portions of the liner, said medial portion being free to move inwardly against the expansible food product when vacuum is applied and then, after another end closure is secured to the other end of the tubular body wall, to move outwardly toward the inner surface of the tubular body wall as the expansible food product expands, whereby the food product can thereafter be removed from the container by removing the label, separating the butted side edges of the body wall with assistance from the positive internal pressure, and removing the food product through the separation in the body wall.

2. A container according to claim 1 wherein the liner comprises a flexible and stretchable liner formed of at least one polymeric layer without foil and paper layers.

3. A container according to claim 1 wherein the butted edges of the strip of body wall material are not secured to each other.

4. A container according to claim 1 further comprising an adhesive band between the liner and the inner surface of the tubular body wall adjacent each end of the tubular body wall for securing the opposed end portions of the liner to the tubular body wall.

5. A container according to claim 1 wherein the container is hermetically sealed.

6. A container according to claim 1 wherein the tubular body wall and the label define a vent for allowing the passage of air therethrough.

7. A container according to claim 1 wherein the end closures are formed of a paperboard material.

8. A container for vacuum packaging food products of a type which expand prior to the container being opened and create a positive internal pressure within the container, said container comprising:

a tubular body wall having opposed ends and inner and outer surfaces, said body wall having a predetermined circumferential strength to at least partially resist expansion of the food product after packaging thereof;

an end closure secured to each one end of the tubular body wall;

a label surrounding the outer surface of the tubular body wall, said label having a predetermined circumferential strength to at least partially resist expansion of the food product together with the circumferential strength of the body wall, and a flexible liner having opposed end portions secured to respective ends of the tubular body wall and a free medial portion between the opposed end portions of the liner, said medial portion being free to move inwardly against the expansible food product when vacuum is applied and then, after another end closure is secured to the other end of the tubular body wall, to move outwardly toward the inner surface of the tubular body wall as the expansible food expands, whereby the food product can thereafter be removed from the container by removing the label, separating the body wall with assistance from the positive internal pressure, and removing the food product though the separation in the body wall.

9. A container according to claim 8 wherein the liner comprises a flexible and stretchable liner formed of at least one polymeric layer without foil and paper layers.

10. A container according to claim 8 further comprising an adhesive band between the liner and the inner surface of the tubular body wall adjacent each end of the tubular body wall for securing the opposed end portions of the liner to the tubular body wall.

11. A container according to claim 8 wherein the container is hermetically sealed.

12. A container according to claim 8 wherein the tubular body wall and the label define a vent for allowing the passage of air therethrough.

13. A container according to claim 8 wherein the end closures are formed of a paperboard material.

14. A container for packaging food products of a type which undergo a decrease in volume prior to the container being opened, said container comprising:

a tubular body wall having opposed ends and inner and outer surfaces and comprising a wound strip of material;

an end closure secured to one end of the tubular body wall;

a flexible liner having opposed end portions secured to respective ends of the tubular body wall and a free medial portion between the opposed end portions of the liner, said medial portion being free to move inwardly against the food product and define a cavity between the flexible liner and the inner surface of the tubular body wall after another end closure is secured to the other end of the tubular body wall; and a vent defined in said tubular body wall to allow air to enter the cavity between the flexible liner and the inner surface of the tubular body wall and allow the medial portion of the liner to move inwardly against the food product as the volume of the food product is decreased.

15. A container according to claim 14 wherein the liner comprises a flexible and stretchable liner formed of at least one polymeric layer without foil and paper layers.

16. A container according to claim 14 wherein the end closures are formed of a paperboard material.

17. A container according to claim 14 wherein said vent comprises a vent hole burned through the body wall material with a laser.

18. A method of packaging expansible food products of a type which expand after being manufactured, said method comprising the steps of:

forming a tubular body wall with opposed ends and a flexible liner adjacent an inner surface of the body wall;

closing one end of the tubular body wall;

depositing the expansible product within the liner and tubular body wall;

creating a negative pressure from the open end of the tubular body wall such that the flexible liner is moved inwardly from the inner surface of the body wall against the product;

closing the open end of the tubular body wall; and allowing the product to expand such that the flexible liner is moved outwardly toward the inner surface of the body wall and a positive pressure is created within the tubular body wall.

19. A method according to claim 18 further comprising the step of forming a vent in the tubular body wall for allowing the passage of air therethrough.

20. A method according to claim 19 wherein said vent forming step comprises directing a laser at the body wall to burn away material and thereby form a vent hole.

21. A method according to claim 18 wherein said forming step further comprises securing a flexible liner formed of at least one polymeric layer without foil and paper layers to the opposed ends of the body wall.

22. A method according to claim 18 wherein said steps of closing the ends of the tubular body wall further comprise hermetically sealing the ends of the tubular body wall with an end closure.

23. A product packaged according to the method of claim 18.

* * * * *